US011557249B2

(12) United States Patent
Lin et al.

(10) Patent No.: US 11,557,249 B2
(45) Date of Patent: Jan. 17, 2023

(54) METHOD OF CONTROLLING DISPLAY PANEL AND CONTROL CIRCUIT USING THE SAME

(71) Applicant: NOVATEK Microelectronics Corp., Hsin-Chu (TW)

(72) Inventors: Chun-Fu Lin, Taoyuan (TW); Jhih-Siou Cheng, New Taipei (TW); Yu-Sheng Ma, Taichung (TW); Jin-Yi Lin, Kaohsiung (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 60 days.

(21) Appl. No.: 17/169,519

(22) Filed: Feb. 7, 2021

(65) Prior Publication Data

US 2021/0375200 A1 Dec. 2, 2021

Related U.S. Application Data

(60) Provisional application No. 63/032,742, filed on Jun. 1, 2020.

(51) Int. Cl.
*G09G 3/3216* (2016.01)
*G09G 3/3266* (2016.01)

(52) U.S. Cl.
CPC ..... *G09G 3/3216* (2013.01); *G09G 3/3266* (2013.01); *G09G 2300/06* (2013.01); *G09G 2310/0251* (2013.01)

(58) Field of Classification Search
CPC ..... G09G 3/3216; G09G 3/3266; G09G 2300/06; G09G 2310/0251
See application file for complete search history.

(56) References Cited

U.S. PATENT DOCUMENTS

| | | | | |
|---|---|---|---|---|
| 7,034,781 | B2 * | 4/2006 | Irmer | G09G 3/3216 345/82 |
| 9,280,930 | B2 * | 3/2016 | Somerville | G09G 3/3216 |
| 2004/0160394 | A1 * | 8/2004 | Irmer | G09G 3/3266 345/82 |
| 2005/0007321 | A1 * | 1/2005 | Schuler | G09G 3/3283 345/82 |
| 2006/0125740 | A1 * | 6/2006 | Shirasaki | G09G 3/325 345/77 |
| 2006/0187157 | A1 * | 8/2006 | Chang | G09G 3/3216 345/82 |
| 2007/0001945 | A1 * | 1/2007 | Yoshida | G09G 3/3233 345/87 |

(Continued)

FOREIGN PATENT DOCUMENTS

| | | | | |
|---|---|---|---|---|
| CN | 1841459 A | * | 10/2006 | G09G 3/22 |
| CN | 101809746 A | * | 8/2010 | G06F 3/0412 |

*Primary Examiner* — Ricardo Osorio
(74) *Attorney, Agent, or Firm* — Winston Hsu

(57) ABSTRACT

The present invention provides a method of controlling a display panel. The display panel includes a plurality of subpixels and a plurality of scan lines coupled to the plurality of subpixels. The method includes steps of: scanning a first scan line among the plurality of scan lines to turn on at least one of the plurality of subpixels coupled to the first scan line during a subframe period among a display frame period; and discharging a second scan line among the plurality of scan lines during a non-display period following the subframe period. Wherein, the second scan line is different from the first scan line.

18 Claims, 11 Drawing Sheets

(56) References Cited

U.S. PATENT DOCUMENTS

| | | | | |
|---|---|---|---|---|
| 2007/0120868 | A1* | 5/2007 | Baek | G09G 3/2022 345/600 |
| 2007/0139318 | A1* | 6/2007 | Kim | G09G 3/3216 345/82 |
| 2007/0152924 | A1* | 7/2007 | Chiou | G09G 3/3283 345/76 |
| 2010/0295861 | A1* | 11/2010 | Somerville | G09G 3/3216 345/82 |
| 2013/0257917 | A1* | 10/2013 | Peng | G09G 3/3688 345/690 |
| 2014/0292741 | A1* | 10/2014 | Yamazaki | H01L 27/1225 345/212 |
| 2014/0347255 | A1* | 11/2014 | Chiu | G09G 3/32 345/82 |
| 2021/0343240 | A1* | 11/2021 | Woo | G09G 3/3266 |

* cited by examiner

METHOD OF CONTROLLING DISPLAY PANEL AND CONTROL CIRCUIT USING THE SAME

CROSS REFERENCE TO RELATED APPLICATIONS

This application claims the benefit of U.S. Provisional Application No. 63/032,742, filed on Jun. 1, 2020, the contents of which are incorporated herein by reference.

BACKGROUND OF THE INVENTION

1. Field of the Invention

The present invention relates to a method of controlling a display panel and a related control circuit, and more particularly, to a method of controlling a passive matrix light-emitting diode (PM-LED) display panel and a related control circuit.

2. Description of the Prior Art

Light-emitting diodes (LEDs) are widely used in displays of electronic devices such as television screens, computer monitors, portable systems such as mobile phones, handheld game consoles and personal digital assistants (PDAs). Please refer to FIG. 1, which is a schematic diagram of a driving architecture of a passive matrix LED (PM-LED) display panel, which includes a constant current source 100 connected to a plurality of LEDs (LED1-LED4), and each LED LED1-LED4 is connected to a switch SW1-SW4, respectively. Under control of the switches SW1-SW4, each LED LED1-LED4 may be driven based on time division.

Please refer to FIG. 2, which illustrates a driving method for the LED display panel of FIG. 1, wherein the display time may be evenly divided into 4 equal parts, and the corresponding switches SW1-SW4 are sequentially turned on to light on the 4 LEDs LED1-LED4 in a time division manner. In order to improve the refresh rate of the image, the display time of the LEDs LED1-LED4 is generally divided into several equal parts. In the example of FIG. 2, it is assumed that the display data includes 16-bit grayscales (totally 65536 grayscale values), and the 16-bit grayscales are divided into 64 equal divisions, so each division has 1024 grayscale values. After the 1024 grayscale values of the LED LED1 are completely displayed, the driving operation is switched to the LEDs LED2, LED3 and LED4 to display 1024 grayscale values in sequence, and then switched back to the LED LED1 to display the next 1024 grayscale values. By the same token, when the LEDs LED1-LED4 complete their displays by 64 times, the display operation of the display data with 16-bit grayscales are completed. In this way, the refresh rate of image may be improved.

The LEDs LED1-LED4 shown in FIG. 1 may correspond to one color on the display panel. For example, a pixel may contain three colors (RGB), and the circuit structure of FIG. 1 may be one of the colors in 4 adjacent pixels, where the current of the same constant current source should be supplied to drive the LEDs with the same color. In other words, the LED pixels with the same color commonly utilize the same constant current source. The 4 adjacent pixels may be composed of three sets of LED driving circuits as in FIG. 1, which respectively correspond to the three colors, RGB, of the pixel. These three sets of driving circuits may operate simultaneously; that is, the corresponding LEDs in different colors are simultaneously lit on. FIG. 1 is only an example of the LED driving circuit. In fact, a display panel may be composed of thousands of LEDs, and a constant current source may be used to drive a great number of LEDs to emit light.

In the conventional PM-LED display panel, due to the switching operations between the LEDs under time division, image sticking easily occurs during the switching process. In order to solve the image sticking problem, a pre-charge circuit may be coupled to the scan lines and a pre-discharge circuit may be coupled to the data lines of the LED display panel. After the end of a display period (or before the start of the next display period), the scan lines and data lines are pre-charged or pre-discharged to accelerate charge releasing of the parasitic capacitors on the scan lines and data lines coupled to the LEDs that do not need to be lit on, preventing the LEDs from being wrongly lit on to cause image sticking.

However, for several unlit LEDs, the coupling of parasitic capacitors during the display process may cause these LEDs to be in the reverse-bias state for a long time, or the reverse voltage difference may become excessively high, resulting in that these LEDs may easy be damaged and their lifespan may be reduced. Thus, there is a need to provide a control method for the PM-LED display panel, to solve the image sticking problems while preventing the LEDs from long-term reverse bias and/or excessive reverse bias.

SUMMARY OF THE INVENTION

It is therefore an objective of the present invention to provide a novel driving method and a related control circuit for a passive matrix light-emitting diode (PM-LED) display panel, in order to solve the problem of long-term and/or excessive reverse bias of the LEDs.

An embodiment of the present invention discloses a method of controlling a display panel. The display panel comprises a plurality of subpixels and a plurality of scan lines coupled to the plurality of subpixels. The method comprises steps of: scanning a first scan line among the plurality of scan lines to turn on at least one of the plurality of subpixels coupled to the first scan line during a subframe period among a display frame period; and discharging a second scan line among the plurality of scan lines during a non-display period following the subframe period. Wherein, the second scan line is different from the first scan line.

Another embodiment of the present invention discloses a control circuit configured to control a display panel. The display panel comprises a plurality of subpixels and a plurality of scan lines coupled to the plurality of subpixels. The control circuit comprises a driving circuit and a scan pre-charge circuit. The driving circuit is configured to scan a first scan line among the plurality of scan lines to turn on at least one of the plurality of subpixels coupled to the first scan line during a subframe period among a display frame period. The scan pre-charge circuit is configured to discharge a second scan line among the plurality of scan lines during a non-display period following the subframe period. Wherein, the second scan line is different from the first scan line.

These and other objectives of the present invention will no doubt become obvious to those of ordinary skill in the art after reading the following detailed description of the preferred embodiment that is illustrated in the various figures and drawings.

DETAILED DESCRIPTION

The image sticking problem encountered on the passive matrix light-emitting diode (PM-LED) display panel may be classified into upward image sticking and downward image sticking. Their causes and solutions are described below.

Figure 1:
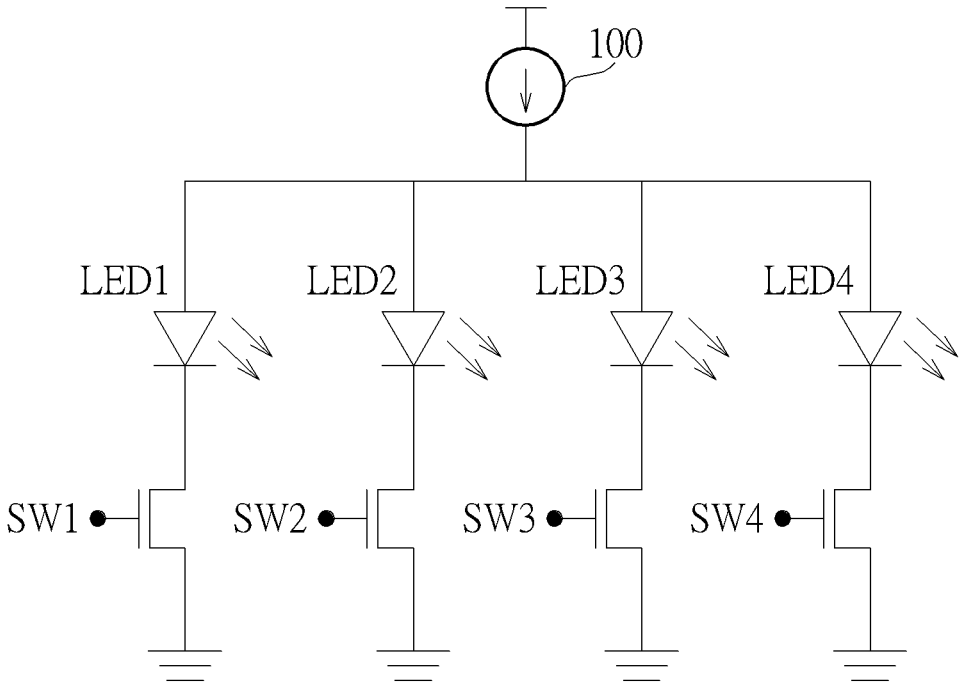
FIG. 1 PRIOR ART
FIG. 1 is a schematic diagram of a driving architecture of a PM-LED display panel.
Figure 3:
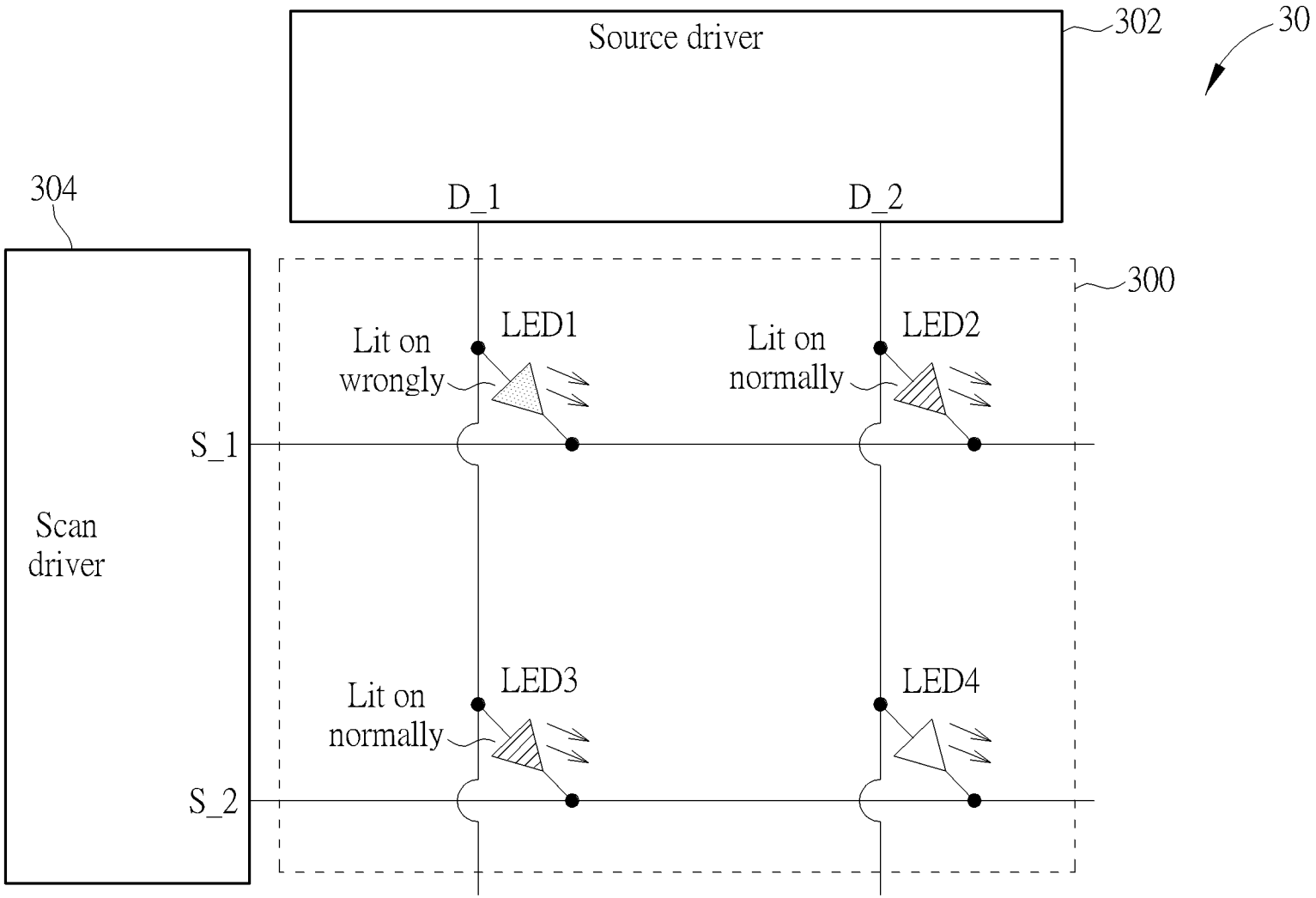
FIG. 3 illustrates the cause of upward image sticking appearing on the display panel.

Please refer to FIG. 3, which is a schematic diagram of a display control system 30. The display control system 30 includes a display panel 300, a source driver 302 and a scan driver 304. The display panel 300 includes a plurality of scan lines, a plurality of data lines and a plurality of subpixels, where only 4 subpixels and their corresponding LEDs LED1-LED4 are shown in FIG. 3 for brevity. These 4 LEDs LED1-LED4 are respectively included in 4 adjacent subpixels distributed as a 2×2 array. Under the structure of the PM-LED display panel, the LEDs LED1-LED4 are controlled by data lines D_1, D_2 and scan lines S_1, S_2. The data lines D_1 and D_2 are coupled to the source driver 302, which is configured to send display data to the data lines D_1 and D_2. In an embodiment, the source driver 302 may include a current source coupled to multiple data lines, as similar to the constant current source 100 shown in FIG. 1. The current source may supply currents to light on the LEDs, to show a desired image on the display panel 300. The scan lines S_1 and S_2 are coupled to the scan driver 304, which is configured to sequentially scan the scan lines S_1 and S_2. In an embodiment, the scan driver 304 may include a power switch, to sequentially switch the scan lines to the low voltage capable of conducting the LEDs.

More specifically, on the display panel 300, the cathode of the LEDs LED1-LED4 is coupled to the scan line S_1 or S_2, and the anode of the LEDs LED1-LED4 is coupled to the data line D_1 or D_2. These subpixels are turned on in series, which means that the LEDs LED1-LED4 are lit on in series. Note that the LEDs LED1-LED4 are lit on in forward bias; hence, the scan lines S_1 and S_2 may be scanned by pulling low their voltages in turn, and the display data are sent to the data lines D_1 and D_2 to selectively pull up the voltages of the data lines D_1 and D_2. Based on time division, during a display frame time, a subframe period may be allocated to each of the LEDs LED1-LED4, and the LEDs LED1-LED4 are selectively lit on and/or the lit-on time of the LEDs LED1-LED4 are well controlled in each subframe period, allowing the LEDs LED1-LED4 to show desired brightness.

FIG. 3 illustrates the cause of upward image sticking appearing on the display panel 300. As shown in FIG. 3, the LEDs LED1-LED4 may be regarded as the 4 LEDs of FIG. 1, which share the same constant current source and are sequentially lit on in a time division manner in an order of LED1, LED2, LED3 and LED4. The scan line S_1 is pulled to a lower voltage (e.g., the ground level) when the LED LED2 is lit on. When the display operation is switched to light on the next LED LED3, the data line D_1 rises to the higher voltage level to output currents to the LED LED3. At this time, since the scan line S_1 has not completely recovered to the higher voltage level, the LED LED1 appears to have a forward bias voltage between its anode and cathode and thus would be wrongly lit on.

Figure 4:
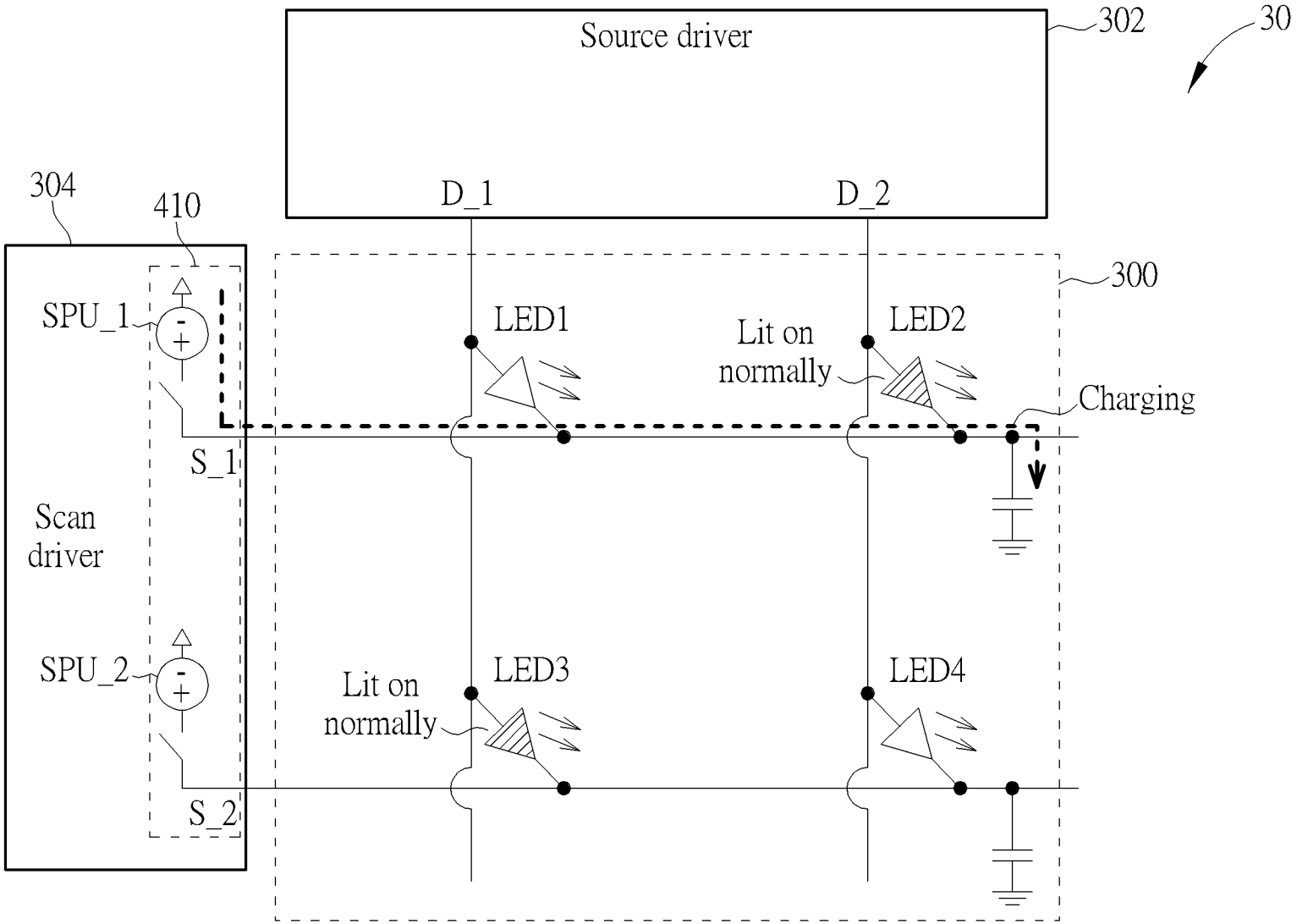
FIG. 4 illustrates the scan pre-charge circuit configured to solve the problem of upward image sticking.

In order to solve the problem of upward image sticking, the scan driver 304 may further include a scan pre-charge circuit 410, as shown in FIG. 4. The scan pre-charge circuit 410 is coupled to one end of the scan lines S_1 and S_2. More specifically, the scan pre-charge circuit 410 may include a plurality of scan pre-charge units SPU_1 and SPU_2 coupled to the scan lines S_1 and S_2, respectively. After the scan operation of the scan line S_1 ends (before the scan operation of the scan line S_2 starts and the LED LED3 is lit on), the voltage of the scan line S_1 may be pulled up through the scan pre-charge unit SPU_1. In an embodiment, each of the scan pre-charge units SPU_1 and SPU_2 may include a voltage source, which may pull up the voltage of the scan line S_1 or S_2 by charging the parasitic capacitor on the scan line S_1 or S_2, as shown in FIG. 4. When the voltage of the scan line S_1 is charged to a higher level, the cathode voltage of the LED LED1 may be increased, allowing the LED LED1 to be reversely biased, which thereby eliminates the problem of upward image sticking.

Figure 5:
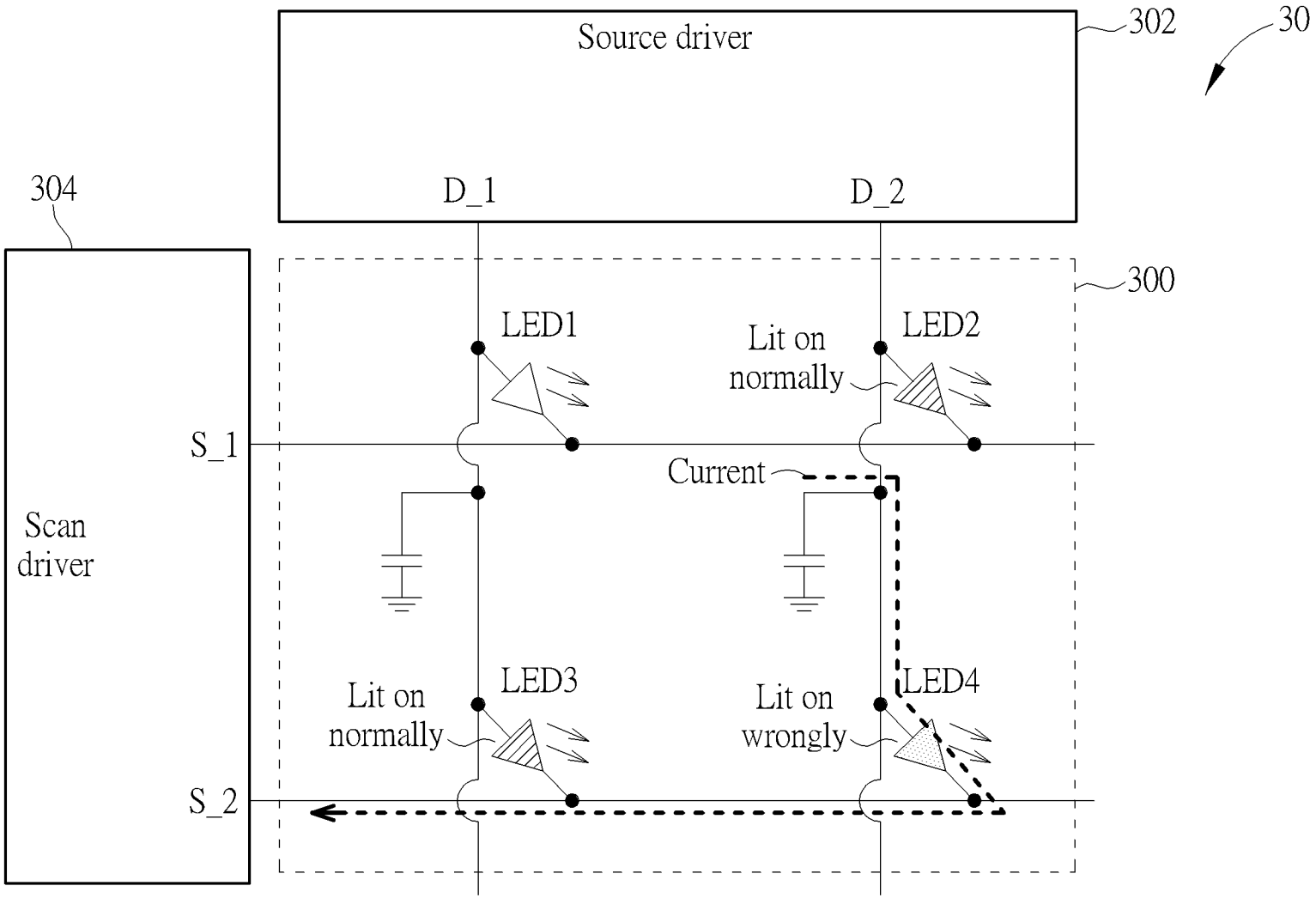
FIG. 5 illustrates the cause of downward image sticking appearing on the display panel.

FIG. 5 illustrates the cause of downward image sticking appearing on the display panel 300, where the downward image sticking is mainly caused by the parasitic capacitors on the data lines. When the LED LED2 is lit on and the display operation tends to switch to light on the next LED LED3, the scan driver starts to scan the scan line S_2 to pull the scan line S_2 to the lower voltage. At this time, the parasitic capacitor on the data line D_2 just completing its display cause the data line D_2 to remain at a high voltage level, making the LED LED4 appear to have a forward bias voltage between its anode and cathode. Under the forward bias voltage, a current from the parasitic capacitor on the data line D_2 may flow to the scan line S_2 through the LED LED4, to wrongly light on the LED LED4.

Figure 6:
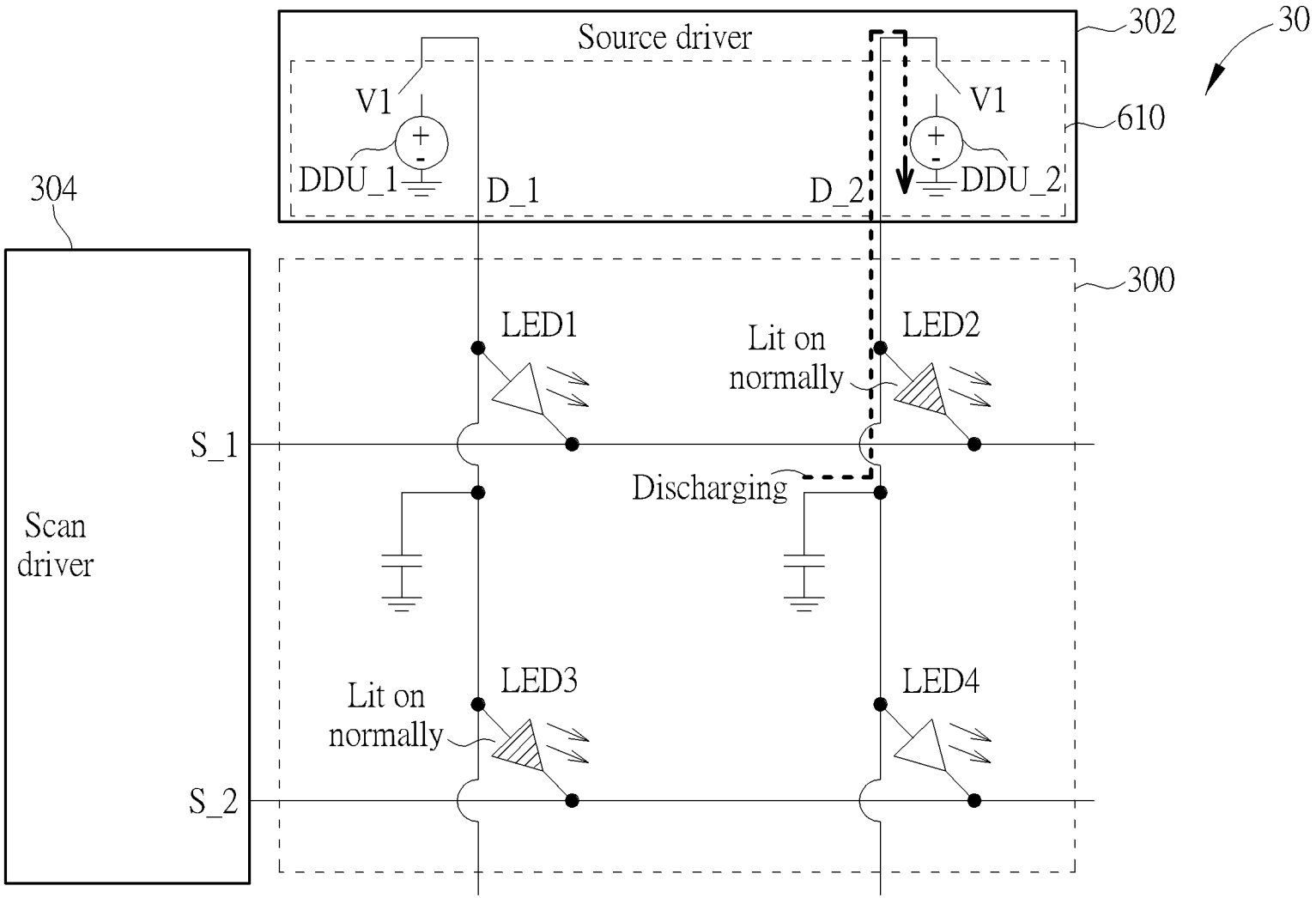
FIG. 6 illustrates the data pre-discharge circuit configured to solve the problem of downward image sticking.

In order to solve the problem of downward image sticking, the source driver 302 may further include a data pre-discharge circuit 610, as shown in FIG. 6. The data pre-discharge circuit 610 is coupled to one end of the data lines D_1 and D_2. More specifically, the data pre-discharge circuit 610 may include a plurality of data pre-discharge units DDU_1 and DDU_2 coupled to the data lines D_1 and D_2, respectively. After display of the LED LED2 is completed, the data pre-discharge circuit 610 may be enabled to release the charges on the parasitic capacitor on the data line D_2; hence, the corresponding data line D_2 may be pulled to a lower voltage level (such as V1) through the data pre-discharge unit DDU_2. This reduces the anode voltage of the LED LED4, allowing the LED LED4 to be reversely biased, thereby eliminating the problem of downward image sticking.

Figure 7:
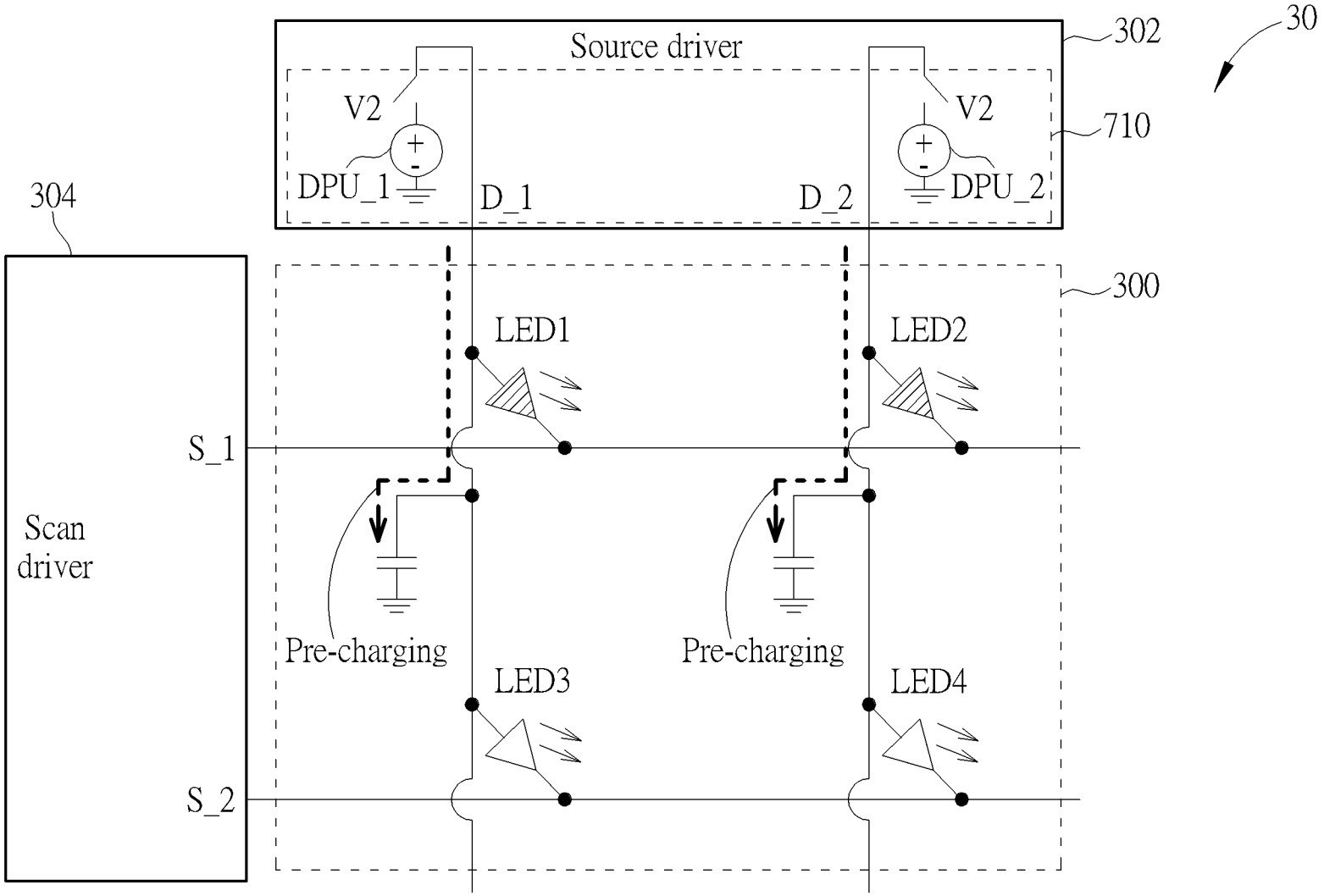
FIG. 7 illustrates the data discharge circuit configured to accelerate the conduction of LEDs.

In addition, the source driver 302 may further include a data pre-charge circuit 710, as shown in FIG. 7. The data pre-charge circuit 710 is coupled to the data lines D_1 and D_2. More specifically, the data pre-charge circuit 710 may include a plurality of data pre-charge units DPU_1 and DPU_2 coupled to the data lines D_1 and D_2, respectively.

The data pre-charge circuit 710 is configured to accelerate the conduction of LEDs. Due to large parasitic capacitors on the data lines D_1 and D_2, the data pre-charge circuit 710 may be used to perform pre-charging on the parasitic capacitors on the data lines D_1 and D_2, in order to pull the data line to a predetermined voltage level (such as V2) before an LED on the data line is turned on. Therefore, the data lines D_1 and/or D_2 may rapidly reach the voltage level for conducting the corresponding LEDs.

It should be noted that each of the scan pre-charge units SPU_1 and SPU_2 shown in FIG. 4, the data pre-discharge units DDU_1 and DDU_2 shown in FIG. 6, and the data pre-charge units DPU_1 and DPU_2 shown in FIG. 7 is represented by a voltage source, which is served to illustrate that the scan pre-charge circuit 410, the data pre-discharge circuit 610 and the data pre-charge circuit 710 are used to drive the scan lines or data lines to reach a predetermined voltage. Note that the data pre-discharge units DDU_1 and DDU_2 and the data pre-charge units DPU_1 and DPU_2 may provide different voltages. In general, the data pre-discharge units DDU_1 and DDU_2 may provide a lower voltage V1 to discharge the data lines D_1 and D_2, and the data pre-charge units DPU_1 and DPU_2 may provide a higher voltage V2 to charge the data lines D_1 and D_2. In fact, each of the scan pre-charge circuit, the data pre-discharge circuit and the data pre-charge circuit may be implemented by any suitable method (such as transistors, resistors, or switches), and the implementations are not intended to limit the scope of the present invention.

In an embodiment, the source driver may include both the data pre-discharge circuit and the data pre-charge circuit, to solve the problem of downward image sticking and also provide pre-charging to accelerate the light emission of LEDs. Also, the scan driver may include a scan pre-charge circuit, to solve the problem of upward image sticking. In addition, both the source driver and the scan driver maybe integrated into a control circuit, such as an integrated circuit (IC) included in a chip. Alternatively, when the source driver is implemented in the IC, the scan driver may be a circuit block implemented on the non-active area of the display panel.

Figure 2:
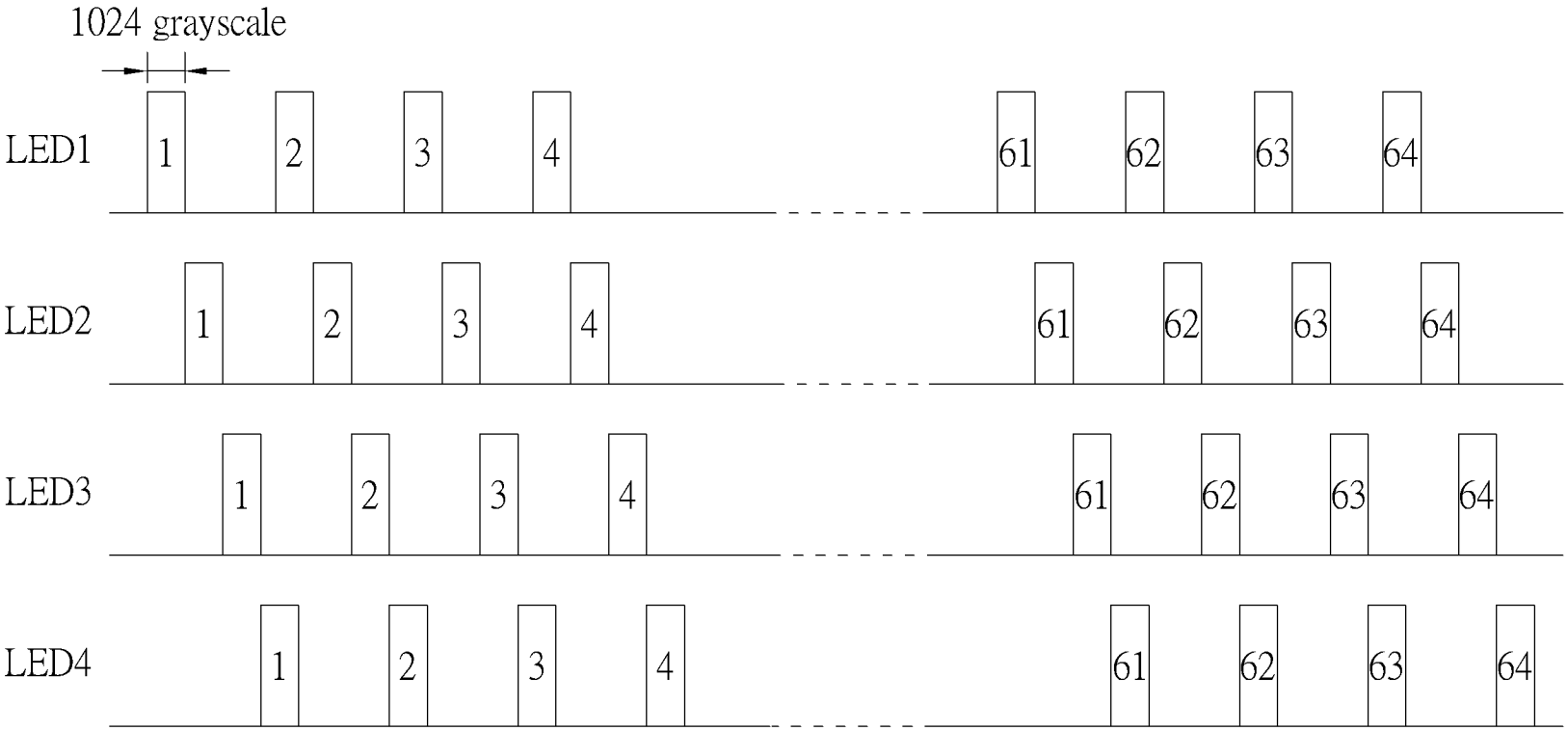
FIG. 2 PRIOR ART
FIG. 2 illustrates a driving method for the LED display panel of FIG. 1.
Figure 8:
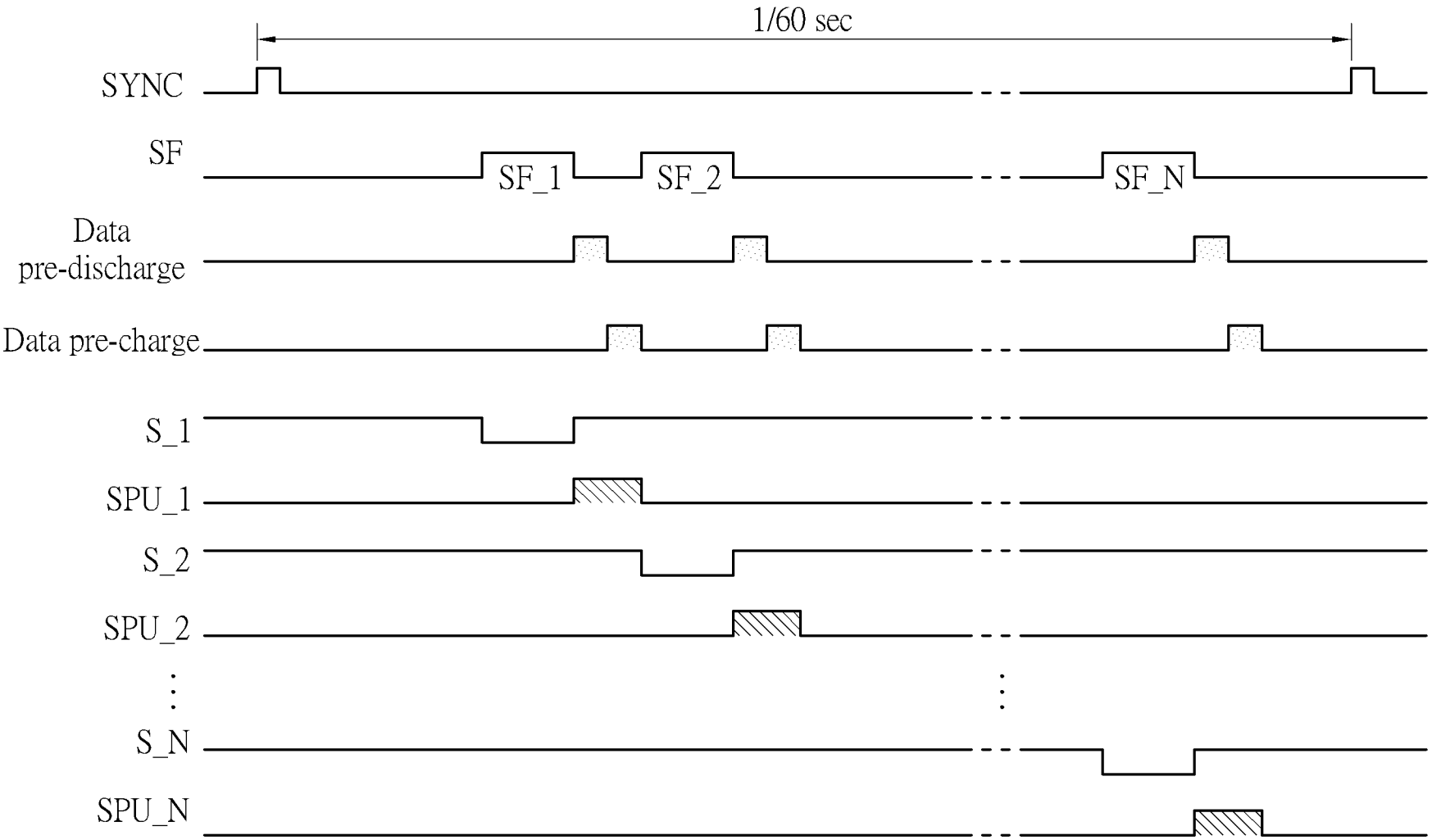
FIG. 8 is a timing diagram of control of a display panel.

Please refer to FIG. 8, which is a timing diagram of control of a display panel, where the abovementioned scan pre-charge circuit, data pre-discharge circuit and data pre-charge circuit are all included in the control circuit. As shown in FIG. 8, the signal SYNC is configured to indicate the start of a display frame period. In general, the signal SYNC may be triggered every 1/60 second, which means that a display frame period equals 1/60 second (60 Hz refresh rate), wherein each display frame period may be divided into multiple subframe periods followed by multiple non-display periods. Each of the subframe periods is a display time where a scan line is scanned and at least one subpixel receives display data through the data line, i.e., at least one LED is configured to be lit on or not based on the display data). Each of the non-display periods may be a blanking interval between two subframe periods. In FIG. 8, the signal SF is configured to indicate the subframe periods and the non-display periods. In this embodiment, the signal SF in "High" level stands for the subframe period, and in "Low" level stands for the non-display period. Referring to FIG. 8 in conjunction with FIGS. 1-2, each subframe period may be a time period where one LED (such as LED1, LED2, LED3 or LED4) may be lit on to display 1024 grayscale values.

Please note that the abovementioned pre-charge/pre-discharge operations for scan lines and data lines may be performed during the non-display period. FIG. 8 shows the operations of the data pre-discharge circuit, the data pre-charge circuit and the scan pre-charge circuit, where the waveform "High" means that the corresponding circuit is enabled to perform charging or discharging, and the waveform "Low" means that the corresponding circuit is disabled.

During each non-display period, the data pre-discharge circuit may be enabled first to release the charges in the parasitic capacitors on the data lines, and the data lines maybe pulled to a lower voltage that allows the LEDs to be reversely biased. After the data lines are discharged, the data pre-discharge circuit may be disabled and the data pre-charge circuit may be enabled, and the data lines may be charged to a higher voltage close to a level that may conduct the LEDs. This may accelerate the conduction of LEDs to facilitate the display operation of the next subframe period.

As for the scan lines, during the non-display period, the scan pre-charge unit for a scan line is enabled after this scan line is scanned; that is, the scan pre-charge unit operates in the non-display period following the subframe period where the corresponding scan line is pulled low. The charging operation of the scan pre-charge unit may prevent the upper image sticking phenomenon from appearing in the next subframe period. In this embodiment, the display panel may include N scan lines S_1-S_N, and the scan pre-charge circuit may include N scan pre-charge units SPU_1-SPU_N coupled to the scan lines S_1-S_N, respectively. The image frame maybe shown by scanning the scan lines S_1-S_N in series.

As shown in FIG. 8, during the subframe period SF_1, the scan line S_1 is scanned; hence, during the non-display period following the subframe period SF_1, the scan pre-charge unit SPU_1 may charge the scan line S_1 to a higher voltage level that allows the LEDs coupled to the scan line S_1 to be reversely biased. For example, in this non-display period, the data lines may be discharged to a specific low voltage through the data pre-discharge circuit, and the scan line S_1 maybe charged to a voltage greater than the specific low voltage, so that the LEDs coupled to the scan line S_1 may be reversely biased and turned off. Similarly, during the subframe period SF_2, the scan line S_2 is scanned; hence, during the non-display period following the subframe period SF_2, the scan pre-charge unit SPU_2 may charge the scan line S_2 to a higher voltage level. During the subframe period SF_N, the scan line S_N is scanned; hence, during the non-display period following the subframe period SF_N, the scan pre-charge unit SPU_N may charge the scan line S_N to a higher voltage level.

Figure 9:
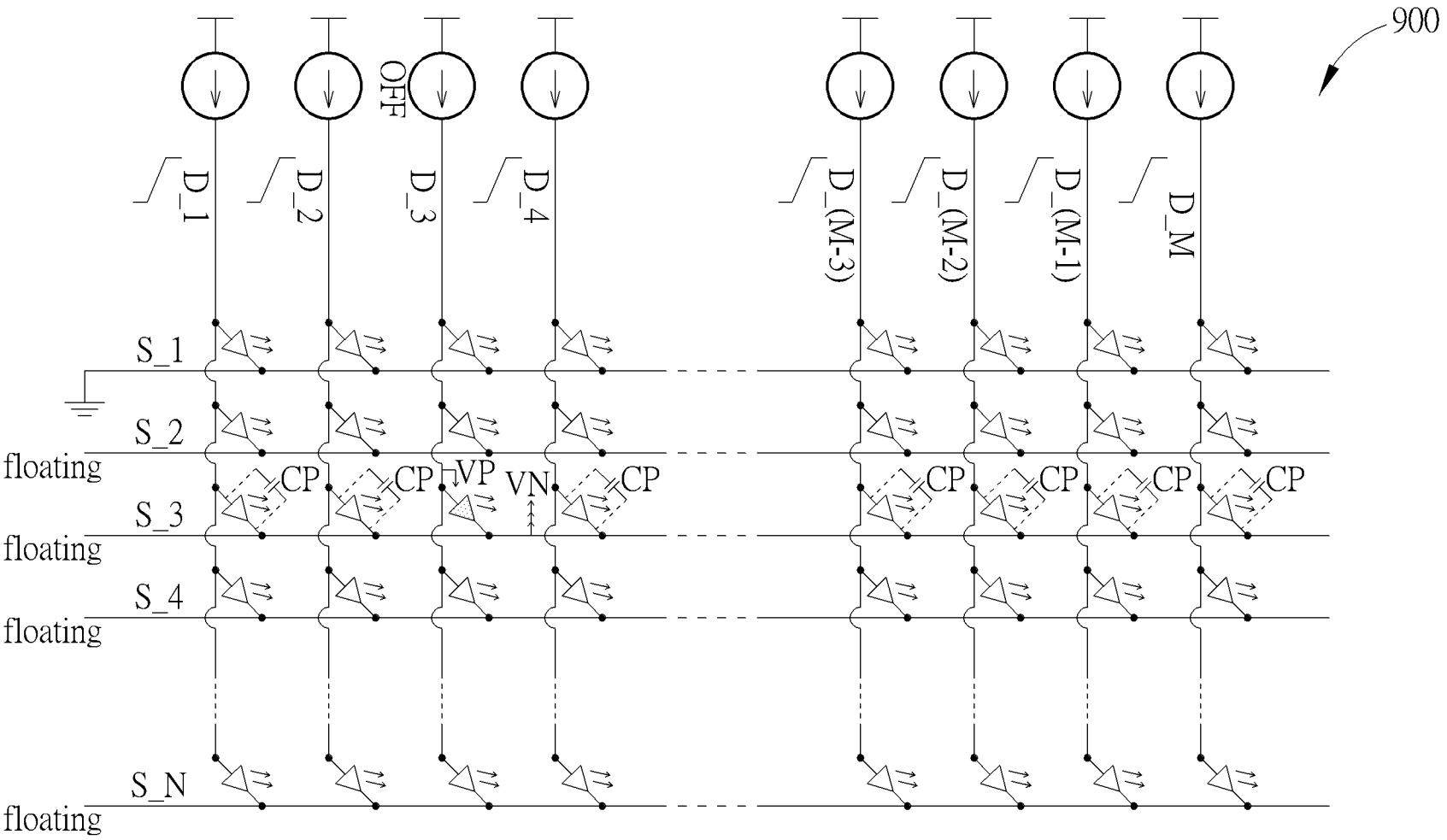
FIG. 9 illustrates the cause of long-term reverse bias appearing on the LEDs.

As mentioned above, the coupling of parasitic capacitors on the display panel may cause the LEDs to be in long-term or excessive reverse bias. FIG. 9 illustrates the cause of long-term reverse bias appearing on the LEDs. In detail, FIG. 9 is a schematic diagram of a display panel 900 having a plurality of LEDs arranged as an M×N array. The LEDs are coupled to N scan lines S_1-S_N and M data lines D_1-D_M. As for each LED, the anode is coupled to one of the data lines D_1-D_M and the cathode is coupled to one of the scan lines S_1-S_N. The data lines D_1-D_M are coupled to a source driver, which includes a plurality of current sources for outputting currents to the data lines D_1-D_M, respectively, based on the display data. The data lines D_1-D_M may further be coupled to a data pre-charge circuit and/or a data pre-discharge circuit (not illustrated). In addition, the scan lines S_1-S_N are coupled to a scan driver and a scan pre-charge circuit (not illustrated).

In general, during a display period such as the subframe period as described above, the scan driver may scan one of the scan lines by pulling this scan line to a low voltage (e.g., ground voltage); meanwhile, the scan driver may control other scan lines to be floating. FIG. 9 shows that the first scan line S_1 is scanned and thus pulled to the ground voltage, while other scan lines S_2-S_N are controlled to be floating. As for those LEDs coupled to the scanned scan line, there may be some LEDs configured to be turned on and some LEDs configured to be turned off according to the display data, and the source driver may provide currents for the data lines correspondingly. Since there is a parasitic capacitor between each data line and each scan line, when an LED is turned on, the voltage of the corresponding data line may be pulled high. At this time, due to the parasitic capacitors between this data line and the scan lines, the voltage on the floating scan lines will be pulled up following the pulled-high voltage on the data line. As a result, the cathode voltage of the LEDs coupled to the scan lines may also rise gradually.

Therefore, if there are a great number of turned-on LEDs, the charges coupled through the parasitic capacitors may be much more, pulling the cathode voltage of the LEDs to a much higher voltage. At this time, if the LED of a certain data line is not turned on, the anode voltage of this LED is at a lower level. After several subframe periods, the capacitor coupling causes that the cathode voltage of the LED becomes higher and higher until the corresponding scan line is scanned, while the anode voltage may still remain at a lower level. In such a situation, the LED may be reversely biased for a long time, and/or may encounter an excessively large reverse voltage difference due to excessively high cathode voltage, resulting in that the LED may be damaged easily.

For example, as shown in FIG. 9, the interval from the end of a scan operation of a scan line (taking S_3 as an example) to the start of the next scan operation of the same scan line S_3 is nearly equal to an entire display frame time. During this period of time, this scan line S_3 is not scanned and may be continuously floating, and its voltage is raised gradually due to the coupling of parasitic capacitors CP. The capacitor coupling appears in every subframe period where other scan lines are scanned and the scan line S_3 is floating. If the LED on the intersection of the scan line S_3 and a certain data line (such as D_3) is not lit on during this period (which means that the corresponding current source is off, and the voltage of the data line D_3 and the anode voltage VP of this LED is in a low level), and meanwhile many LEDs on other channels are lit on (which means that most of other data lines are pulled to the high voltage such that the scan line is raised by a larger level due to coupling of the parasitic capacitors CP), the scan line S_3 may be pulled to an even higher voltage level when floating, resulting in that the cathode voltage VN of this LED becomes excessively high. In such a situation, the degree of the long-term reverse bias of this LED ($VP-VN<0$) will be more serious.

Therefore, based on the display data, there may be several LEDs turned on and several LEDs turned off in each subframe period. The most severe situation is that a specific LED is turned off while other LEDs on the same scan line are all turned on; hence, this specific LED may have a high voltage difference in reverse bias.

In order to solve the problem of excessive reverse bias or long-term reverse bias, the present invention provides a scan method for the display panel, where a scan line may be charged or discharged in a non-display period following a subframe period where another scan line is scanned. In an embodiment, suppose that the scan lines S_1-S_N are respectively controlled by the scan pre-charge units SPU_1-SPU_N of the scan pre-charge circuit. If the scan line S_1 is scanned in a subframe period, the scan pre-charge unit SPU_3 may be enabled to discharge the scan line S_3 in the non-display period following the subframe period. As mentioned above, the voltage of the scan line S_3 may be pulled high through the parasitic capacitors CP during the subframe period where the scan line S_1 is scanned (and the scan line S_3 is floating). Therefore, the scan pre-charge unit SPU_3 is served to discharge the scan line S_3 to pull its voltage down to an appropriate level during the following non-display period.

Therefore, in the non-display period following the subframe period of scanning the scan line S_1, the scan pre-charge unit SPU_1 may charge the scan line S_1 to prevent the upward image sticking. Meanwhile, the scan pre-charge unit SPU_3 may be enabled to discharge the scan line S_3 when the scan line S_1 is charged through the scan pre-charge unit SPU_1, in order to prevent the LEDs on the floating scan line S_3 from excessive reverse bias. As mentioned above, each scan pre-charge unit may be implemented with a voltage source, which may drive the corresponding scan line to an appropriate voltage by charging or discharging the scan line. In this embodiment, the voltage of the scan line S_3 may be pulled high through the parasitic capacitors in the subframe period, and thus the scan pre-charge unit SPU_3 may be served to discharge the scan line S_3 to an appropriate voltage during the following non-display period. The voltage of the scan line S_1 is pulled low when the scan line S_1 is scanned in the subframe period, and thus the scan pre-charge unit SPU_1 may be served to charge the scan line S_1 to an appropriate voltage during the following non-display period.

Preferably, the scan pre-charge circuit may charge or discharge a scan line by pulling the scan line to a predetermined voltage level, and this predetermined voltage level allows the LEDs coupled to this scan line to be reversely biased within a specific voltage difference. Note that the scan pre-charge circuit is usually operated during the non-display period. If the scan pre-charge circuit drives the scan line to an excessively low voltage such that several LEDs coupled to the scan line enter the forward-bias state, these LEDs may be lit up wrongly. If the scan pre-charge circuit drives the scan line to an excessively high voltage such that several LEDs coupled to the scan line are in excessively reverse bias, these LEDs may be damaged easily. Therefore, the scan pre-charge circuit and the voltage source therein should provide an appropriate voltage for the cathode of the LEDs, allowing the LEDs to be reversely biased within an appropriate voltage difference.

Figure 10:
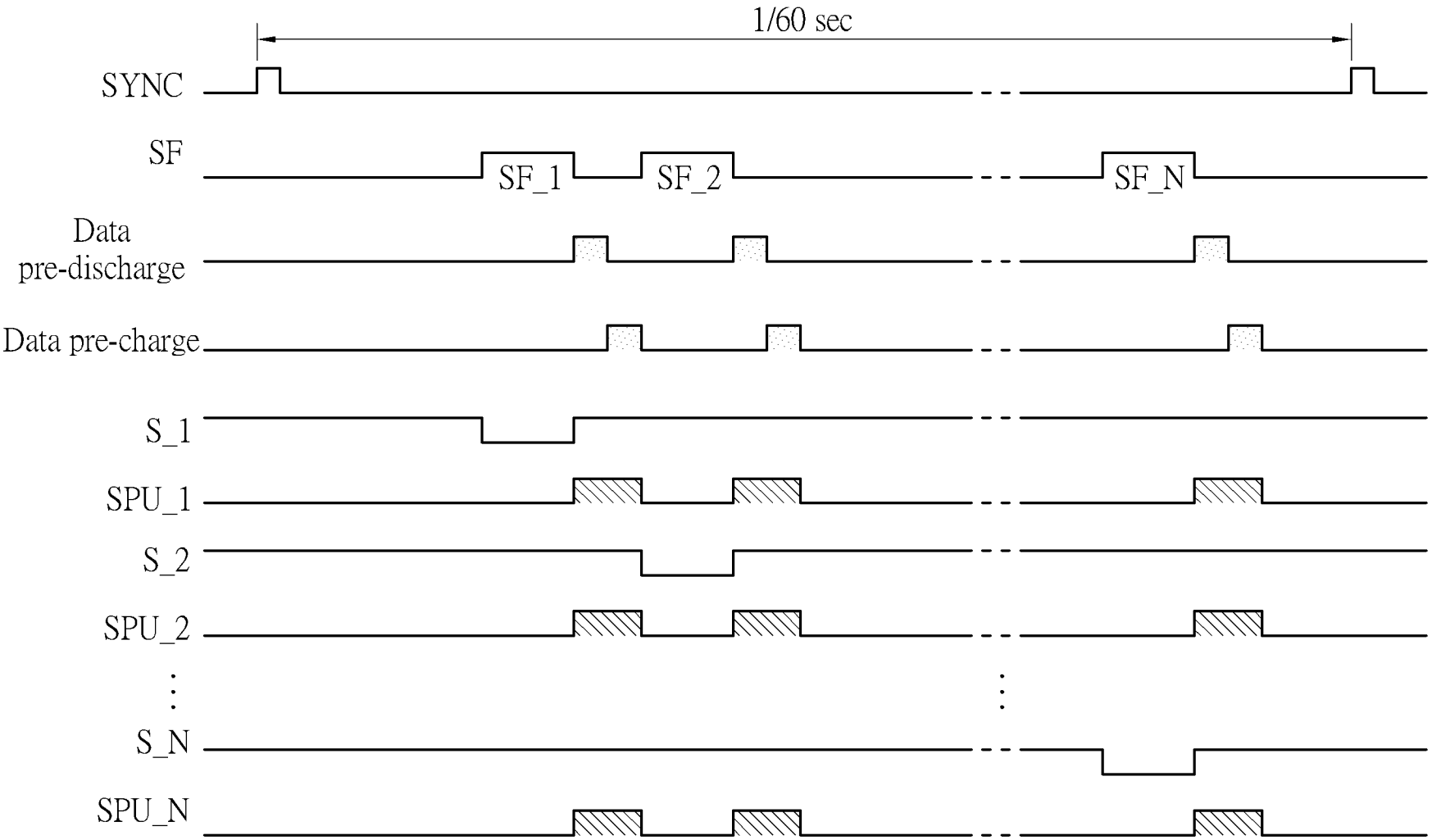
FIG. 10 is a timing diagram of control of a display panel according to an embodiment of the present invention.

In an embodiment, in order to provide a preferable protection of excessive reverse bias, the scan pre-charge circuit may perform charging or discharging on all scan lines during a non-display period. In such a situation, the scanned scan line may recover to an appropriate voltage level to avoid upward image sticking, and the floating scan line may be pulled to an appropriate voltage level that may prevent the LEDs from excessive reverse bias. Please refer to FIG. 10, which is a timing diagram of control of a display panel according to an embodiment of the present invention. The display panel may be a PM-LED display panel configured with the scan pre-charge circuit, data pre-discharge circuit and data pre-charge circuit. The operations of the signals SYNC and SF and the operations of the data pre-discharge circuit and the data pre-charge circuit illustrated in FIG. 10 are similar to those illustrated in FIG. 8, and will be omitted herein. Similarly, in FIG. 10, as for the pre-charge and pre-discharge circuits, the waveform "High" means that the corresponding circuit is enabled to perform charging or discharging, and the waveform "Low" means that the corresponding circuit is disabled.

The difference between the control timing of FIG. 10 and the control timing of FIG. 8 is in the operations of the scan pre-charge circuit. As shown in FIG. 10, the display frame period includes a plurality of subframe periods SF_1-SF_N and a plurality of non-display periods respectively following the subframe periods SF_1-SF_N. During a non-display period, the scan pre-charge circuit performs charging or discharging on each scan line. Therefore, not only the scanned scan line is charged to an appropriate voltage to avoid image sticking, but also the floating scan lines are discharged to an appropriate voltage to prevent the excessive reverse bias of the LEDs.

In addition, as for a scan line, the scan pre-charge circuit may perform charging or discharging on the scan line during multiple non-display periods (e.g., during each of the non-display periods within a display frame period), no matter whether the scan line is scanned in the previous subframe period. This allows the floating scan line to recover to an appropriate voltage after the end of each subframe period, so as to prevent long-term reverse bias of the LEDs since the LEDs' cathode voltage may not be continuously pulled high in multiple subframe periods.

As shown in FIG. 10, each scan line is charged or discharged through the scan pre-charge circuit during each non-display period, which is different from FIG. 8 where the scan pre-charge circuit on each scan line performs charging only when this scan line just completes scanning. Therefore, the cathode voltage of the LEDs on each scan line maybe well controlled in each subframe display cycle. As a result, the long-term reverse bias and excessive reverse bias of the LEDs may be prevented, extending the lifespan of the LEDs.

In an embodiment, the discharging time of the scan line may overlap the charging time of the data line during the non-display period. In other words, the scan pre-charge circuit may drive the voltage of the scan line to the appropriate level at the time when the data pre-charge circuit starts to charge the data line. Preferably, during the non-display period, the discharge operation of the scan line may at least cover the time of the data line starts to be charged by the data pre-charge circuit, e.g., extended throughout the non-display period, as shown in FIG. 10. Note that the charging operation of the data pre-charge circuit may pull high the voltage of the data lines, and may cause the voltage of the scan lines to be pulled high with coupling of the parasitic capacitors if the scan lines are floating. Therefore, at the start time of charging the data lines, the scan pre-charge circuit should be enabled to control each scan line to be in a specific voltage, thereby preventing the scan line from being pulled to an excessively high voltage during the charging of the data lines.

Preferably, the charging/discharging operations of the scan pre-charge circuit may be performed during the non-display period, but should not be performed during the display period (i.e., the subframe period). Note that the display panel has a large quantity of parasitic capacitors coupled between the data lines and the scan lines. Therefore, during the subframe period where one scan line is scanned, other scan lines should be floating to reduce or prevent the influences of the parasitic capacitors of the scan lines. If the non-scanned scan lines are forced to be in a voltage rather than floating, the parasitic capacitors coupled to these scan lines may be charged when the source driver pulls high the voltage of the data lines, which limits the speed of pulling high the anode voltage of the LEDs, thereby reducing the emission speed of the LEDs.

In an embodiment, the voltage of the scan pre-charge circuit performing pre-charging should be greater than the voltage of the data pre-discharge circuit performing pre-discharging. For example, if the data pre-discharge circuit is configured to pull the data line to a voltage VA after the non-display period starts, the scan pre-charge circuit should be configured to pull the scan line to a voltage VB greater than VA. This facilitates the elimination of image sticking. In this manner, the anode and cathode voltages of the LEDs may be well controlled to be in reverse bias, and the voltage difference of the LEDs may be well controlled to be in an appropriate level. As a result, the image sticking phenomenon may be avoided, and the LEDs may not be in excessive reverse bias.

Please note that the present invention aims at providing a method of controlling the display panel to prevent image sticking and also prevent long-term and excessive reverse bias of the LEDs. Those skilled in the art may make modifications and alterations accordingly. For example, in the above embodiments, the anode of the LEDs is coupled to the data line and the cathode of the LEDs is coupled to the scan line. In another embodiment, the anode of the LEDs may be coupled to the scan line while the cathode of the LEDs maybe coupled to the data line, and the levels of the scan signals and the display data may be controlled accordingly. The structure of subpixels of the display panel should not be a limitation of the scope of the present invention.

In addition, in the embodiments of the present invention, a scan line is pre-charged in the non-display period following the subframe period where another scan line is scanned. In several embodiments, the scan line may not be pre-charged in all non-display periods for the sake of reducing power or any other purpose. For example, in an embodiment, each scan line maybe pre-charged in every two or three non-display periods, or alternatively, all scan lines may be simultaneously pre-charged in several non-display periods during a display frame period in addition to their pre-charge operations following the scanned subframe period. In such a situation, the long-term and/or excessive reverse bias problem due to capacitor coupling may still be mitigated.

Figure 11:
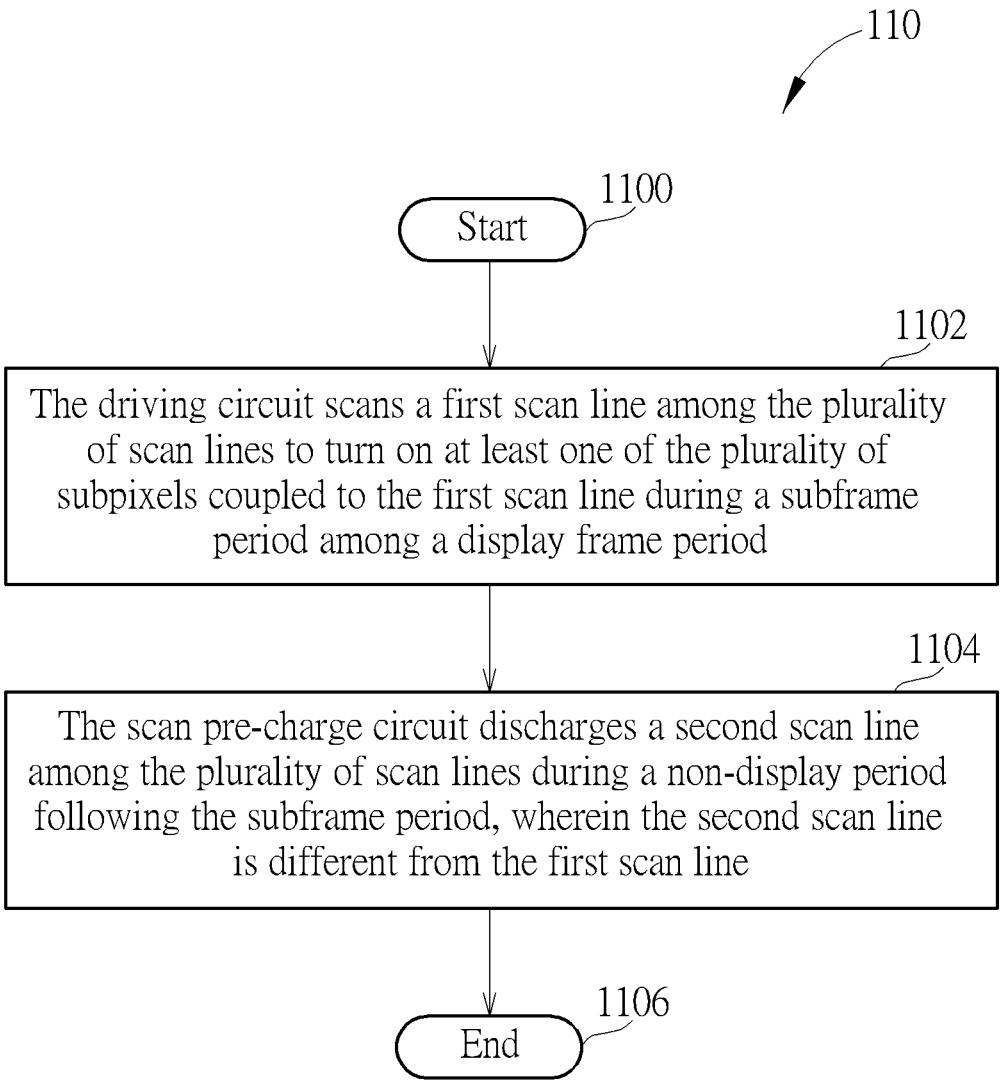
FIG. 11 is a flowchart of a process according to an embodiment of the present invention.

The abovementioned operations of driving the display panel may be summarized into a process 110, as shown in FIG. 11. The process 110 may be implemented in a control circuit including the source driver and the scan driver, where the scan driver may include a driving circuit for scan driving and a scan pre-charge circuit for pre-charging operation. As shown in FIG. 11, the process 110 includes the following steps:

Step 1100: Start.

Step 1102: The driving circuit scans a first scan line among the plurality of scan lines to turn on at least one of the plurality of subpixels coupled to the first scan line during a subframe period among a display frame period.

Step 1104: The scan pre-charge circuit discharges a second scan line among the plurality of scan lines during a non-display period following the subframe period, wherein the second scan line is different from the first scan line.

Step 1106: End.

The detailed operations and alterations of the process 110 are illustrated in the above paragraphs, and will not be narrated herein.

To sum up, the embodiments of the present invention provide a method of controlling a display panel, specifically a PM-LED display panel, and a related control circuit. The display panel includes a plurality of subpixels arranged as an array, and each of the subpixels is composed of an LED. Each LED is coupled to a data line via the anode and coupled to a scan line via the cathode. The control circuit includes a source driver and a scan driver, where the display panel is controlled by the source driver through the data lines and controlled by the scan driver through the scan lines. In the display control operation, a display frame period may be divided into a plurality of subframe periods and a plurality of non-display periods respectively following the subframe periods. In each subframe period, a scan line may be scanned and other scan lines may be controlled floating. When a first scan line is scanned during a subframe period, a scan pre-charge circuit of the scan driver may charge the first scan line during a non-display period following the subframe period, to prevent image sticking. Meanwhile, the scan pre-charge circuit may discharge a second scan line different from the first scan line during the same non-display period, to prevent the LEDs coupled to the second scan line from long-term and/or excessive reverse bias. In an embodiment, the scan pre-charge circuit maybe implemented with a voltage source, which is configured to drive the scan line to an appropriate voltage by charging or discharging the scan line, to control the voltage difference of the LEDs to be reversely biased within an appropriate level, thereby preventing the image sticking and the long-term and/or excessive reverse bias. Therefore, as for a scan line, the scan pre-charge circuit may perform charging or discharging on the scan line during multiple non-display periods within a display frame period, no matter whether the scan line is scanned in the previous subframe period. This allows the floating scan line (i.e., non-scanned scan line) to recover to an appropriate voltage after the end of each subframe period, so as to prevent the LEDs from long-term and/or excessive reverse bias.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of controlling a display panel, the display panel comprising a plurality of subpixels and a plurality of scan lines coupled to the plurality of subpixels, the method comprising:

scanning a first scan line among the plurality of scan lines to turn on at least one of the plurality of subpixels coupled to the first scan line during a subframe period among a display frame period; and charging or discharging the first scan line and a second scan line among the plurality of scan lines during a non-display period following the subframe period;

wherein the second scan line is different from the first scan line, and the second scan line is not scanned in the subframe period.

2. The method of claim 1, further comprising:

charging or discharging all of the plurality of scan lines during the non-display period following the subframe period.

3. The method of claim 1, wherein the display frame period comprises a plurality of subframe periods and a plurality of non-display periods respectively following the plurality of subframe periods, and the method further comprises:

charging or discharging each of the plurality of scan lines during each of the plurality of non-display periods.

4. The method of claim 1, wherein the step of discharging the second scan line comprises:

pulling the second scan line to a predetermined voltage level, wherein the predetermined voltage level allows a light-emitting diode (LED) in at least one of the plurality of subpixels coupled to the second scan line to be reversely biased within a specific voltage difference.

5. The method of claim 1, wherein the display panel further comprises a plurality of data lines coupled to the plurality of subpixels, and the method further comprises:

discharging a first data line among the plurality of data lines to a first voltage during the non-display period; and charging the first data line to a second voltage during the non-display period after discharging the first data line.

6. The method of claim 5, wherein during the non-display period, a voltage of the second scan line is driven by a scan pre-charge circuit at a time when the first data line starts to be charged.

7. The method of claim 5, wherein the step of discharging the second scan line comprises:

discharging the second scan line to a third voltage greater than the first voltage.

8. The method of claim 1, further comprising:

controlling the plurality of scan lines except for the first scan line to be floating when scanning the first scan line during the subframe period.

9. The method of claim 1, wherein the display panel is a passive matrix light-emitting diode (PM-LED) display panel.

10. A control circuit configured to control a display panel, the display panel comprising a plurality of subpixels and a plurality of scan lines coupled to the plurality of subpixels, the control circuit comprising:

a driving circuit, configured to scan a first scan line among the plurality of scan lines to turn on at least one of the plurality of subpixels coupled to the first scan line during a subframe period among a display frame period; and a scan pre-charge circuit, configured to charge or discharge the first scan line and a second scan line among the plurality of scan lines during a non-display period following the subframe period;

wherein the second scan line is different from the first scan line, and the second scan line is not scanned in the subframe period.

11. The control circuit of claim 10, wherein the scan pre-charge circuit is further configured to charge or discharge all of the plurality of scan lines during the non-display period following the subframe period.

12. The control circuit of claim 10, wherein the display frame period comprises a plurality of subframe periods and a plurality of non-display periods respectively following the plurality of subframe periods, and the scan pre-charge circuit is further configured to charge or discharge each of the plurality of scan lines during each of the plurality of non-display periods.

13. The control circuit of claim 10, wherein the scan pre-charge circuit is configured to pull the second scan line to a predetermined voltage level, wherein the predetermined voltage level allows a light-emitting diode (LED) in at least one of the plurality of subpixels coupled to the second scan line to be reversely biased within a specific voltage difference.

14. The control circuit of claim 10, wherein the display panel further comprises a plurality of data lines coupled to the plurality of subpixels, and the control circuit further comprises:

a data pre-discharge circuit, configured to discharge a first data line among the plurality of data lines to a first voltage during the non-display period; and a data pre-charge circuit, configured to charge the first data line to a second voltage during the non-display period after the data pre-discharge circuit discharges the first data line.

15. The control circuit of claim 14, wherein the scan pre-charge circuit is configured to drive a voltage of the second scan line at a time when the data pre-charge circuit starts to charge the first data line during the non-display period.

16. The control circuit of claim 14, wherein the scan pre-charge circuit is configured to discharge the second scan line to a third voltage greater than the first voltage.

17. The control circuit of claim 10, wherein the driving circuit is further configured to control the plurality of scan lines except for the first scan line to be floating when scanning the first scan line during the subframe period.

18. The control circuit of claim 10, wherein the display panel is a passive matrix light-emitting diode (PM-LED) display panel.

* * * * *